US005488998A

United States Patent [19]

Ekwall et al.

[11] Patent Number: 5,488,998

[45] Date of Patent: Feb. 6, 1996

[54] FLUID DRIVEN DOWN-THE-HOLE DRILLING MACHINE

[75] Inventors: Berndt Ekwall, Saltsjöbaden; Martin Peterson, Nacka, both of Sweden

[73] Assignee: Atlas Copco Rocktech AB, Stockholm, Sweden

[21] Appl. No.: 270,133

[22] Filed: Jul. 1, 1994

[30] Foreign Application Priority Data

Jul. 12, 1993 [SE] Sweden ..... 9302391

[51] Int. Cl.[6] ..... B25D 9/02

[52] U.S. Cl. ..... 173/91; 173/132; 175/296

[58] Field of Search ..... 173/91, 132, 133, 173/135, 17, 73, 80; 175/296

[56] References Cited

U.S. PATENT DOCUMENTS

| | | | |
|---|---|---|---|
| 660,411 | 10/1900 | Blum | 173/91 |
| 1,005,770 | 10/1911 | Clark | 175/296 |
| 1,680,254 | 8/1928 | Nelson | 173/91 |
| 2,812,922 | 11/1957 | Blount et al. | 173/91 |
| 3,038,548 | 6/1962 | Brown | 173/132 |
| 5,163,519 | 11/1992 | Mead et al. | 173/91 |
| 5,226,487 | 7/1993 | Spektor | 173/91 |

*Primary Examiner*—Scott A. Smith
*Attorney, Agent, or Firm*—Mark P. Stone

[57] ABSTRACT

Fluid driven down-the-hole drilling machine. The hammer piston (2) of the down-the-hole drilling machine is adjacent to its front end provided with a cylindrical part (6). The drill bit (3) is provided with a first impact surface (41) which receives impacts during drilling, a second impact surface (42) and an annular section (7) which surrounds the cylindrical part (6) between the impact surfaces. The second impact surface (42) receives the impact energy of the hammer piston at reversed feeding of the housing (1) of the down-the-hole drilling machine for freeing the drill bit when it has become stuck.

3 Claims, 1 Drawing Sheet

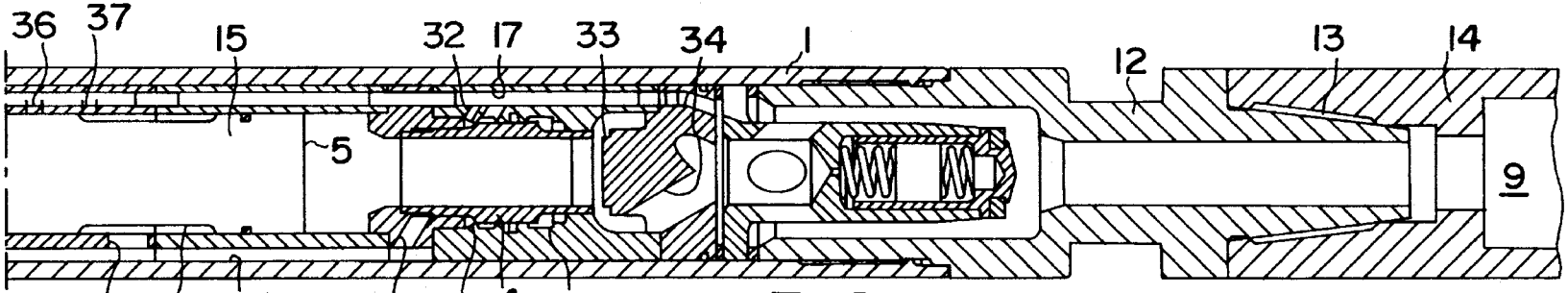
FIG. IB
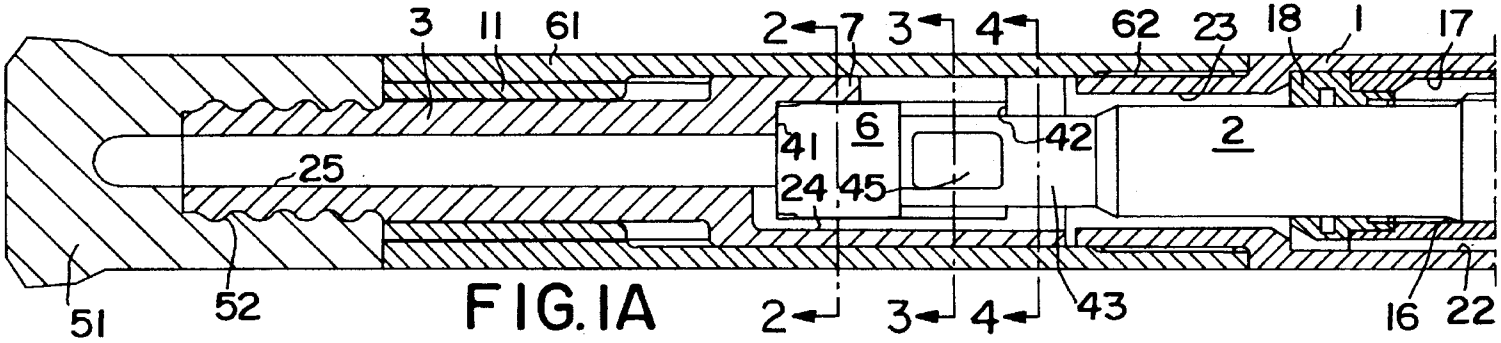
FIG. IA
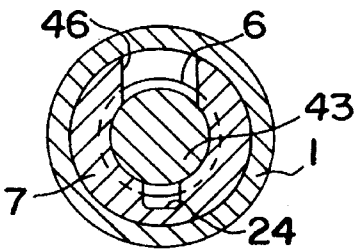
FIG. 4
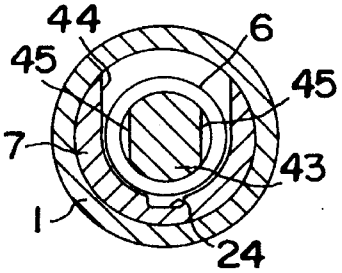
FIG. 3
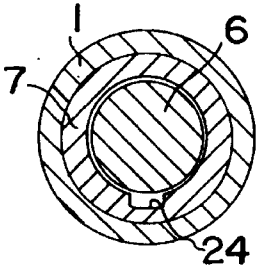
FIG. 2

FLUID DRIVEN DOWN-THE-HOLE DRILLING MACHINE

BACKGROUND OF THE INVENTION

The present invention relates to a fluid driven down-the-hole drilling machine, i.e. a drilling machine driven by liquid or gas. More specifically the invention relates to a down-the-hole drilling machine provided with a backhammer for freeing a drill bit which has become stuck.

In a prior art backhammer for down-the-hole drilling machines, see DE 3802391, a separate backhammer unit is used which when needed is connected to the drill string in order to free the drill bit by means of impacts in a direction away from the drill bit. This device is very time-consuming to use.

SUMMARY OF THE INVENTION

The present invention, which is defined in the subsequent claims, aims at achieving a fluid driven down-the-hole drilling machine where the drill bit is easily freed when stuck through reverse feed of the down-the-hole drilling machine.

BRIEF DESCRIPTION OF THE DRAWINGS

An embodiment of the invention is described below with reference to the accompanying drawing in which FIG. 1A shows the front part of a fluid driven down-the-hole drilling machine according to the invention.

FIG. 1B shows the rear part of the down-the-hole drilling machine.

FIG. 2 shows a section according to 2—2 in FIG. 1A.

FIG. 3 shows a section according to 3—3 in FIG. 1A.

FIG. 4 shows a section according to 4—4 in FIG. 1A.

DESCRIPTION OF THE BEST MODES FOR CARRYING OUT THE INVENTION

The fluid driven down-the-hole drilling machine shown in the drawing comprises a housing 1 in the front end of which a drill bit 3 is arranged. The drill bit is connected to the housing 1 by means of a splined coupling 11. The drill bit comprises a shaft part 3 and a head part 51 provided with not shown hard metal bottons. The shaft part 3 and the head part 51 are connected with each other by means of a thread coupling 52. The housing 1 is at its rear end provided with an end piece 12 which by means of a thread coupling 13 is connected to a tube suing 14. The drill bit 3 is during drilling turned through rotation of the tube string 14, end piece 12 and housing 1 via the splined coupling 11. Fluid for the driving of the down-the-hole drilling machine is supplied from a not shown pump via the channel 9 in the tube string. The channel 9 thus functions as a pressure source. A hammer piston 2 is movable to-and-fro in the housing 1. The hammer piston is provided with a piston head 15 with a first driving surface 5. The hammer piston 2 is guided in the housing 1 by the piston head 15 and a guide 18. The hammer piston 2 is provided with a second driving surface 16 which is continuously pressurized via channel 17 during drilling. The to-and-fro movement of the hammer piston is controlled by the valve 4 which alternately connects the driving surface 5 to the pressure source 9 or to a low pressure via channels 21, 22, slot 23, groove 24 and channel 25 to the environment for flushing of the borehole. The chamber 31 around the valve 4 is continuously pressurized via channels 17 and 32. This pressure strives at moving the valve 4 to the right in the drawing for cooperation with a valve seat 33, through which the connection between the pressure source 9 and the first driving surface 5 via channel 34 is interrupted. Through this the connection via channels 21 and 22 to low pressure is opened. The movement to-and-fro of valve 4 is controlled by the pressure in chamber 35 which surrounds valve 4. Pressurization of chamber 35 moves valve 4 to the left in the drawing since the pressurized surface in chamber 35 is larger than the pressurized surface in chamber 31. The chamber 35 is via not shown channels connected to holes in the cylinder wall surrounding the hammer piston 2. These holes, which lie in another section than the one shown, are marked with the reference numerals 36 and 37. In the shown position of the hammer piston 2 chamber 35 is connected to low pressure via channel 37, the turndown 38 on the hammer piston 2 and the channels 39 and 22. When the hammer piston is in its rearward position chamber 35 is pressurized via the channel 17 and the channel 36.

The hammer piston 2 is at its front end formed with a cylindrical part 6. Adjacent to the cylindrical part the hammer piston is formed with a part 43 with reduced diameter. The part with reduced diameter is provided with two diametrically oppositely arranged plane surfaces 45. The shaft part 3 of the drill bit is rearwardly formed with an annular section 7 which surrounds the major part of the cylindrical part 6 of the hammer piston. The drill bit 3 comprises a first impact surface 41 against which the hammer piston 2 impacts during drilling. The drill bit 3 furthermore comprises a second impact surface 42 against which the cylindrical part 6 can impact when the housing 1 is fed in a direction away from the drill bit 3. The annular section 7 comprises a first slot 44 the width of which allows the cylindrical part 6 on the hammer piston 2 to be moved into the drill bit 3 from the side when the front tube 61 of the housing 1 has been loosened at the thread coupling 62. The annular section 7 furthermore comprises a second slot 46 the width of which corresponds to the distance between the two plane surfaces 45 on the part 43 with reduced diameter so that this part can pass the second slot 46 at the same time as the cylindrical part 6 is moved in through the first slot 44. Since the part 43 with reduced diameter has been made with two plane surfaces 45 the second slot 46 can be made narrower. This means that the surface of the second impact surface 42 can be made larger so that stress is reduced.

The drill bit 3 is mounted in the following way. The shaft part 3 and the head part 51 are separated from each other and the tube 61 of the housing 1 is screwed off. In this state the hammer piston 2 protrudes from the housing 1. The shaft part 3 is aligned so that the cylindrical part 6 on the hammer piston 2 can be moved into the shaft part 3 through the first slot 44 at the same time as the two plane surfaces 45 on the hammer piston 2 are held in position for passage through the second slot 46. After this the shaft part 3 is moved on to the hammer piston 2 from the side and is pushed to the right in the drawing to the position shown in the drawing. After this the tube 61 is pushed on to the shaft part 3 so that the splined coupling 11 is created, after which the thread coupling 62 is fastened. After this the head part 51 is screwed on to the shaft part 3.

The shown fluid driven down-the-hole drilling machine works in the following way. At drilling the hammer piston is driven to-and-fro as described above for impacting the drill bit 3. If the drill bit tends to become stuck the feed is reversed, i.e. the tube string 14 is driven to the right in FIG. 1B. Through this the cylindrical part 6 on the hammer piston 2 will impact the second impact surface 42 during the movement to-and-fro of the hammer piston 2, through which the drill bit will be impacted to become free. This operation is automatically obtained at reverse feed.

We claim:

1. Fluid driven down-the-hole drilling machine comprising a housing (1), a hammer piston (2) movable to-and-fro in the housing for impacting a drill bit (3) arranged in the housing and a valve (4) for alternately connecting at least one (5) of two driving surfaces (5, 16) on the hammer piston to a pressure source (9) and low pressure, characterized in that the hammer piston (2) comprises a cylindrical part (6), a drill bit (3) comprising a first impact surface (41), a second impact surface (42) and an annular section (7) arranged between said impact surfaces and surrounding a major part of said cylindrical part on the hammer piston (2), wherein said first impact surface (41) is impacted during drilling and said second impact surface (42) transfers impact energy from the hammer piston (2) to the drill bit (3) when said housing (1) is fed in a direction away from the drill bit (3).

2. Fluid driven down-the-hole drilling machine comprising a housing (1), a hammer piston (2) movable to-and-fro in the housing for impacting a drill bit (3) arranged in the housing and a valve (4) for alternately connecting at least one (5) of two driving surfaces (5, 16) on the hammer piston to a pressure source (9) and low pressure, characterized in that the hammer piston (2) comprises a cylindrical part (6), a drill bit (3) comprising a first impact surface (41), a second impact surface (42) and an annular section (7) arranged between said impact surfaces and surrounding a major part of said cylindrical part on the hammer piston (2), wherein said first impact surface (41) is impacted during drilling and said second impact surface (42) transfers impact energy from the hammer piston (2) to the drill bit (3) when said housing (1) is fed in a direction away from the drill bit (3), the hammer piston adjacent to said cylindrical part (6) being provided with a part (43) having a reduced diameter less than that of the cylindrical part, and the drill bit (3) between said impact surfaces (41, 42) being provided with a first slot (44), through which said cylindrical part (6) can be moved into the drill bit (3) from a side of the drill bit.

3. Fluid driven down-the-hole drilling machine comprising a housing (1), a hammer piston (2) movable to-and-fro in the housing for impacting a drill bit (3) arranged in the housing and a valve (4) for alternately connecting at least one (5) of two driving surfaces (5, 16) on the hammer piston to a pressure source (9) and low pressure, characterized in that the hammer piston (2) comprises a cylindrical part (6), a drill bit (3) comprising a first impact surface (41), a second impact surface (42) and an annular section (7) arranged between said impact surfaces and surrounding a major part of said cylindrical part on the hammer piston (2), wherein said first impact surface (41) is impacted during drilling and said second impact surface (42) transfers impact energy from the hammer piston (2) to the drill bit (3) when said housing (1) is fed in a direction away from the drill bit (3), the hammer piston adjacent to said cylindrical part (6) being provided with a part (43) having a reduced diameter less than that of the cylindrical part, and the drill bit (3) between said impact surfaces (41, 42) being provided with a first slot (44), through which said cylindrical part (6) can be moved into the drill bit (3) from a side of the drill bit, said part (43) with said reduced diameter on the hammer piston (2) comprising two diametrically oppositely arranged plane surfaces (45), and the drill bit comprises a second slot (46), wherein the part (43) with said reduced diameter on the hammer piston (2) at the plane surfaces (45) moves through said second slot (46) at the same time as said cylindrical part (6) is moved into the drill bit (3) through said first slot (44).

* * * * *